US009302813B2

(12) United States Patent
Crawford et al.

(10) Patent No.: US 9,302,813 B2
(45) Date of Patent: Apr. 5, 2016

(54) INVERTIBLE BOTTLE WITH AN IMPROVED CLOSURE

(75) Inventors: John C. Crawford, Mahopac, NY (US); Kiat-Cheong Toh, Forest Hills, NY (US); Michael P. Robinson, New York, NY (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/402,645

(22) PCT Filed: Jun. 7, 2012

(86) PCT No.: PCT/US2012/041211

§ 371 (c)(1), (2), (4) Date: Nov. 20, 2014

(87) PCT Pub. No.: WO2013/184112

PCT Pub. Date: Dec. 12, 2013

(65) Prior Publication Data

US 2015/0144585 A1 May 28, 2015

(51) Int. Cl.

| | |
|---|---|
| ***B65D 23/00*** | (2006.01) |
| ***B65D 1/02*** | (2006.01) |
| ***B65D 51/24*** | (2006.01) |

(52) U.S. Cl.

CPC ..... *B65D 23/001* (2013.01); *B65D 1/0246* (2013.01); *B65D 51/249* (2013.01)

(58) Field of Classification Search

CPC .. B65D 23/001; B65D 51/249; B65D 1/0246; B65D 1/023

USPC ..... 220/288; 215/43, 329, 316

See application file for complete search history.

(56) References Cited

U.S. PATENT DOCUMENTS

| | | | |
|---|---|---|---|
| 5,632,420 | A | 5/1997 | Lohrman et al. |
| D529,810 | S | 10/2006 | Davies et al. |
| D531,047 | S | 10/2006 | Hiolin et al. |

(Continued)

FOREIGN PATENT DOCUMENTS

| | | |
|---|---|---|
| CN | 2428406 | 5/2001 |
| CN | 2920857 | 7/2007 |

(Continued)

OTHER PUBLICATIONS

The International Search Report and the Written Opinion of the International Searching Authority issued in International Application PCT/US2012/041211 mailed Mar. 5, 2013.

(Continued)

*Primary Examiner* — Robert J Hicks

(57) ABSTRACT

A bottle has a body and an opening at a first end of the bottle. A closure for the opening is movable relative to the body. The bottle, optionally the closure, comprises first and second elements lying in a plane substantially perpendicular to a main axis extending between the first end and an opposite second end of the bottle when the closure is in the closed position, the first and second elements being respective portions of the first end that are furthest along the main axis from the second end. The bottle, optionally the closure, also comprises a recessed portion extending between the first and second elements, the recessed portion being recessed from the plane in a direction along the main axis towards the second end, whereby the first and second elements are separated from each other in the plane by a gap.

32 Claims, 3 Drawing Sheets

(56) References Cited

U.S. PATENT DOCUMENTS

| | | | |
|---|---|---|---|
| 2003/0146249 | A1 | 8/2003 | Fulwood |
| 2009/0152286 | A1 | 6/2009 | Wilson |

FOREIGN PATENT DOCUMENTS

| | | |
|---|---|---|
| FR | 1344476 | 11/1963 |
| JP | 7267261 | 10/1995 |
| JP | 2000219256 | 8/2000 |
| WO | WO2008/061817 | 5/2008 |

OTHER PUBLICATIONS

The Written Opinion of the International Preliminary Examining Authority issued in International Application PCT/US2012/041211 mailed Jun. 3, 2014.

INVERTIBLE BOTTLE WITH AN IMPROVED CLOSURE

CROSS-REFERENCE TO RELATED PATENT APPLICATIONS

The present application is a U.S. national stage entry under 35 U.S.C. §371 of Patent Cooperation Treaty Patent Application No. PCT/US2012/041211, filed Jun. 7, 2012, the entirety of which is incorporated herein by reference.

FIELD OF THE INVENTION

The present invention relates to a bottle, and more particularly to an invertible bottle, i.e. a bottle with two opposite ends that is designed to stand on either of the two opposite ends on a resting surface, and with a closure provided at one of the ends for closing an opening to an internal chamber of the bottle.

BACKGROUND OF THE INVENTION

There are many known bottles for holding and dispensing products. Some of these bottles are referred to herein as invertible bottles. Invertible bottles are bottles with first and second opposite ends that are designed such that the bottle can stand stably on a support surface through contact with either of the ends with the support surface, and with a closure or cap that is disposed at the first end. The bottle is usually stored with its second, base end in contact with the support surface, but may be inverted (particularly when much of the product contained in the bottle has been used up) so that the first, closure end is instead placed on a support surface. This is in contrast to non-invertible bottles, in which a closure is provided at a top end opposite to a base end on which the bottle stands, and the bottle is unable to stand stably on its top end. Over time and due to gravity, the product in a bottle settles towards its lowermost end. Invertible bottles provide the advantage that, with the bottle inverted, the product in the bottle settles towards the end having the closure, such that the product can be dispensed readily once the closure is opened. This avoids a user necessarily having to rotate the bottle to orientate the opening at the lowest point of the bottle, and then wait for the product to flow towards the opening, as is the case for non-invertible bottles. Such a wait could be for several seconds when the product is particularly viscous.

Some known invertible bottles suffer from the problem that, once a required dose of the product has been dispensed and the opening has subsequently been re-sealed by the closure, often an amount of the product remains on the exterior of the bottle around the closure end. This is particularly the case when the product contained in the bottle is a body wash, shower gel, shampoo or other product that might be dispensed onto a user's hand, since the user's hand cups the dispensed product and causes an amount of the product to be spread onto the surface of the bottle around the closure end. Once the closure end of the bottle is placed back on the resting surface, such as on a counter, a shelf, or the rim of a bath, the product remaining on the exterior of the bottle dries out, giving the bottle an unattractive appearance. Subsequent dispensing operations can lead to the addition of further product on the outside of the closure end, which itself will also dry out over time. The dried product may later become mixed with fresh product from within the bottle during a subsequent dispensing operation, leading to less than satisfactory performance of the product. If the product is a food item, this also can be unhygienic.

The top end and/or closure of a non-invertible bottle may be of practically any shape, since the form of the top end and closure does not usually affect the stability of the bottle when placed on its opposite, base end. However, in the case of an invertible bottle, the shapes of the closure end and the closure itself are dictated by the requirement for the bottle to be sufficiently stable when placed on its closure end. For this reason, many known invertible bottles have completely flat, or planar, closure ends that extend over most or all of the width and depth of the bottle perpendicular to its height, or alternatively have a closure end including an annular rim that extends from the closure end and extends fully around the perimeter of the closure end. Either of these forms can give the bottle an unappealing, sometimes utilitarian, appearance. Moreover, these forms can permit pooling of significant amounts of water or other liquid on the closure end due to surface tension.

Accordingly, there is a need for an improved invertible bottle that enables the avoidance, minimization or reduction of collection over time of product or liquid on the exterior of the bottle around its closure end. Furthermore, there is a need for greater freedom of design when it comes to determining the shape of a closure end of an invertible bottle.

BRIEF SUMMARY OF THE INVENTION

The present invention provides a bottle comprising: a body having an internal chamber and an opening, the opening being at a first end of the bottle; and a closure movable relative to the body between a closed position at which the closure prevents the chamber from being in fluid communication with an exterior of the bottle, and an open position at which the chamber is in fluid communication with the exterior of the bottle via the opening; wherein the first end of the bottle comprises first and second elements and a recessed portion extending from the first element to the second element; wherein each of the first and second elements is a line or a planar surface in a plane substantially perpendicular, or perpendicular, to a main axis extending between the first end of the bottle and an opposite second end of the bottle, the first and second elements being respective portions of the first end of the bottle that are furthest along the main axis from the second end of the bottle; wherein the recessed portion is recessed from the plane in a direction along the main axis towards the second end of the bottle, whereby the first and second elements are separated from each other in the plane by a gap, the first and second elements together occupying a first area in the plane; wherein the recessed portion projects, in a direction parallel to the main axis, a second area onto the plane; and wherein the first area is between 1% and 25% of the sum of the first and second areas.

The closure is that part of the bottle which, in normal use of the bottle, is repeatedly movable by a user between the closed and opened positions without irreversibly destroying the bottle.

As used throughout, ranges are used as shorthand for describing each and every value that is within the range. Any value within the range can be selected as either terminus of the range.

The recessed portion may be considered to include (a) the surface portion(s) facing the plane that define the profile of the closure between the first and second elements and when the bottle is viewed in a viewing direction perpendicular to the main axis and perpendicular to the direction in which the recessed portion extends from the first element to the second element, and (b) optionally also any surface portion(s) facing the plane between the first and second elements and obscured from view by the first and/or second elements when the bottle is viewed in the viewing direction.

The recessed portion may include one or more surface portions that face the plane and is/are parallel to the plane, and/or one or more surface portions that are, at most, at no more than a certain angle to the plane. The certain angle may be up to 45°, more preferably up to 30°, more preferably up to 20°, and most preferably up to 15° to the plane. Accordingly, in most cases, surface(s) of the bottle that are near-vertical (i.e. nearly aligned with the main axis) would not be considered to be comprised in the recessed portion.

According to the second aspect of the invention, the first area is equal to the sum of areas in the plane occupied by the first and second elements, and the recessed portion does not lie in the plane but faces the plane and, were the recessed portion to be projected in the direction of the main axis onto the plane, it would occupy the second area in the plane. Put another way, were the recessed portion to be deformed and transposed onto the plane, it would occupy the second area of the plane.

Preferably the first area is from any one of 1%, 3%, 4% and 5% of the sum of the first and second areas to any one of 10%, 15% and 20% of the sum of the first and second areas. More preferably, the first area is between 1% and 5% of the sum of the first and second areas.

Preferably one or each of the first and second elements is a planar surface.

The following optional features are applicable to either aspect of the present invention, unless otherwise stated.

Preferably the first and second areas together define an ellipse or a circle. One or each of the first and second elements may occupy an area in the plane that is a sector or a segment of the ellipse or of the circle. Preferably the first element is diametrically opposite the second element in the ellipse or in the circle.

Preferably a tangent to an edge of the second area is tangential to a part of one of the first and second elements at the point where the edge meets the part. That is, when the first and second elements are planar surfaces, preferably edge(s) of the recessed portion transition(s) smoothly into edge(s) of one or both of the first and second planar surfaces when viewed in a direction along the main axis. Alternatively, when the first and second elements are lines, preferably edge(s) of the recessed portion transition(s) smoothly into the lines when viewed in a direction along the main axis.

Preferably the bottle has a width in a first direction perpendicular to the main axis and a depth in a second direction perpendicular to both the main axis and the first direction. The width may be greater than the depth, in which case the bottle may have two large or wide opposite sides and two smaller or narrower opposite sides.

Preferably the first and second elements are spaced apart in the first direction by a distance that is more than 40% of the width, optionally more than 50% of the width.

Preferably one or each of the first and second elements extends in the first direction by a distance that is between 2% and 10% of the width. More preferably the distance is between 3% and 8% of the width, and most preferably is between 4% and 6% of the width.

Preferably one or each of the first and second elements extends in the second direction by a distance that is between 15% and 70% of the depth, optionally between 30% and 55% of the depth, further optionally between 38% and 45% of the depth.

Optionally one or each of the first and second elements is symmetrical about a first axis that lies in the plane and/or symmetrical about a second axis that lies in the plane and is substantially perpendicular to the first axis. Both the first and second elements may be symmetrical about the same, first axis. The second element may be a mirror image of the first element about the second axis. The first axis may extend in the first direction with the second axis extending in the second direction. Accordingly, the bottle may have good stability when standing on the first and second elements. Most preferably, the first axis lies midway across the depth of the bottle and extends in the direction of the width of the bottle, and/or the second axis lies midway across the width of the bottle and extends in the direction of the depth of the bottle.

Preferably one or each of the first and second elements is provided midway across the depth of the bottle, so as to provide the bottle with improved stability when standing in an inverted manner.

Preferably the recessed portion extends in the first direction from the first element to the second element. The recessed portion may extend in the first and/or second direction to a greater extent than one or each of the first and second elements.

In the bottle of the second aspect of the invention, optionally the first and second elements are comprised in the closure. Alternatively, the first and second elements may be comprised in the body, and may be integral with the rest of the body. That is, the body may be a unitary component including the first and second elements. Alternatively, the first and second elements may be adhered or otherwise joined to the rest of the body.

The first and second elements may be integral with the rest of the closure. That is, the closure may be a unitary component including the first and second elements. Alternatively, the first and second elements may be adhered or otherwise joined to the rest of the closure.

Optionally, the bottle is a unitary component comprising the body and the closure.

The size of an area in the plane occupied by the first element may be substantially equal to the size of an area in the plane occupied by the second element. Alternatively or additionally, the first element may be substantially the same shape as the second element.

One or both of the first and second elements may be substantially arc- or crescent-shaped. That is, one or both of the elements may have a shape that follows an arc- or crescent-shaped path in the plane.

In the bottle of the second aspect of the invention, optionally one or each of the first and second elements is non-annular. By "non-annular" it is meant that each of the first and second elements does not define a circuit in the plane enclosing an area or space in the plane. Moreover, through the provision of the gap, the first and second elements are distanced from each other in the plane and are unconnected within the plane.

Preferably, when the first and second elements are in contact with a resting surface, between the first and second elements there is a space between the recessed portion and the resting surface. This may be advantageous since water is permitted to flow through the space to remove contents of the bottle that remain on the first end after dispensing.

Preferably the closure remains connected to the body during movement of the closure relative to the body between the closed position and the open position. The closure may be connected to the body via a hinge, such as a living hinge. Alternatively, the closure may be disconnectable from the body, e.g. by unscrewing or unclipping the closure from the body, to place the closure in the open position.

The bottle may comprise a first part and a second part connected to the first part, wherein the body forms the first part and a first portion of the second part, and wherein the closure forms a second portion of the second part. The second part may be connected to the first part by snap-fit, adhesion, welding, or by any other means. The first and second parts may together be a unitary component.

In the bottle of any aspect of the present invention, preferably the first and second elements are the only portions of the bottle that lie in the plane. Alternatively, the bottle may comprise further elements lying in the plane. For example, the bottle may comprise the first and second elements and also a third element and optionally also a fourth element. The first to third (or fourth) elements may be substantially equally spaced from one another in the plane, such that the bottle has good stability when standing in an inverted manner on the elements.

The bottle, more specifically the body and/or the closure, of any aspect of the present invention may be made from a plastics material such as a thermoplastic polymer, e.g. polypropylene (PP), a polyester such as polyethylene terephthalate (PET), or any one of polystyrene (PS), low density or high density polyethylene (LDPE, HDPE), acrylonitrile butadiene styrene (ABS), cellulose propionate (CP), polyacrylate, polycarbonate, and styrene acrylonitrile (SAN). The body may be made of one of these materials while the closure is made of a different one of these materials, or both the body and the closure may be made of the same material. In any event, the body may have a different colour to the closure or the body and closure may have the same colour. Similarly, the body and the closure may have a different finish, for example, the closure may include a glossy finish while the body may not. It is understood that the color, finish, and/or materials used in producing the bottle in no way limit the scope of the invention.

By way of example, the bottle of any aspect of the present invention may contain within its internal chamber any one of the following products: a personal care product, an oral care product, a household cleaning product, and a food item.

By providing the bottles of the various aspects of the present invention with the gap separating the first and second elements or surfaces, when the first and second elements or surfaces are standing on a resting surface, water, such as water from a shower head, is permitted to flow through a space defined between the recessed portion and the resting surface, so as to wash away some, much or all of any product remaining on the exterior of the first end of the bottle.

Moreover, the bottle designer has much more freedom when it comes to designing the shape of the rest of the first end of the bottle around the first and second elements or surfaces, since only the form of the first and second elements or surfaces, which are separated by the gap and thus do not extend across the full width and depth of the bottle perpendicular to its height in the main axial direction, is dependent on the requirement for the bottle to be able to stand stably in an inverted manner. The rest of the first end could take practically any shape. Indeed, the present invention provides an invertible bottle that has unobstrusive means for stably placing the bottle in the upside down position without sacrificing the aesthetics.

BRIEF DESCRIPTION OF THE DRAWINGS

Embodiments of the present invention will now be described by way of example with reference to the accompanying drawings, in which.

DETAILED DESCRIPTION OF THE PREFERRED EMBODIMENTS

Figure 1:
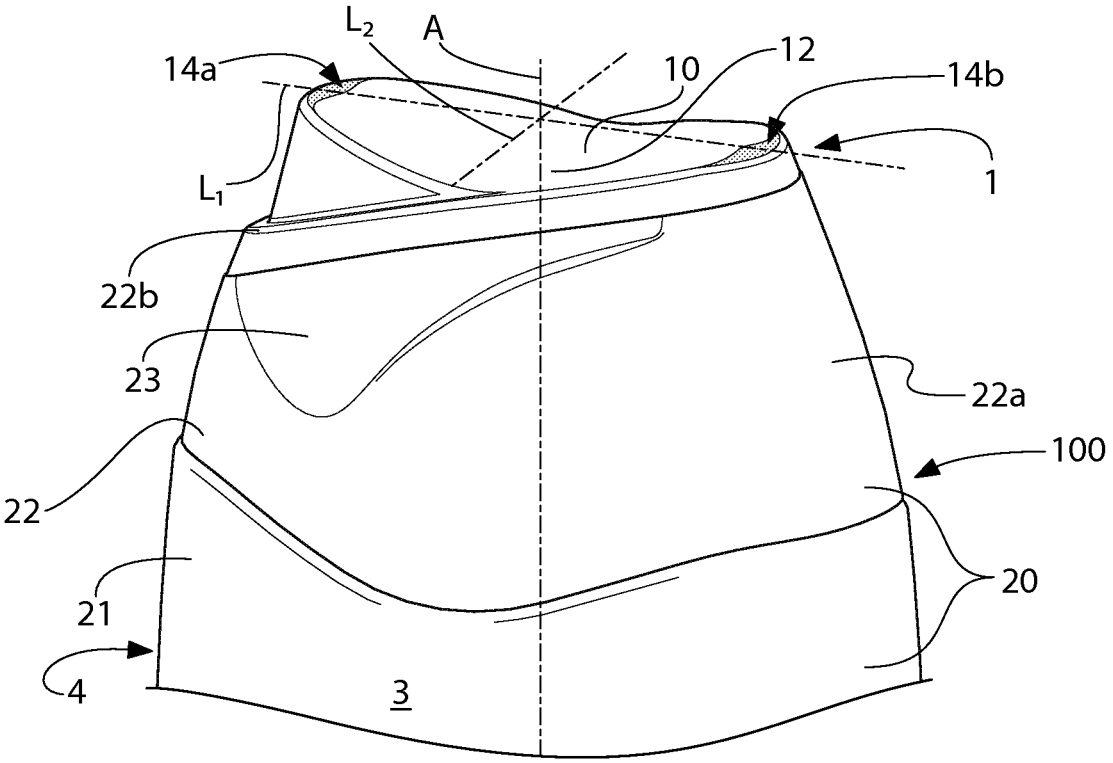
FIG. 1 is a perspective view of a portion of a bottle according to a first embodiment of the present invention.

The following description of the preferred embodiments is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features.

Figure 2:
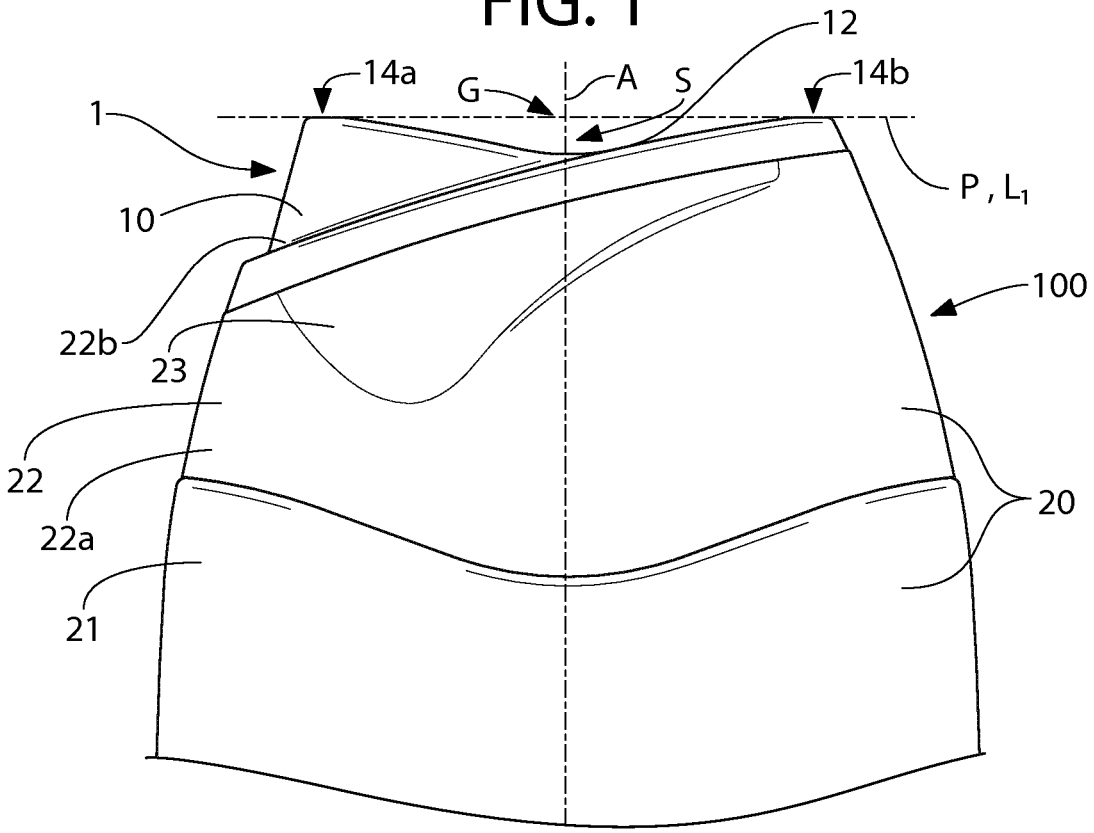
FIG. 2 is a front view of the portion of the bottle of FIG. 1.
Figure 3:
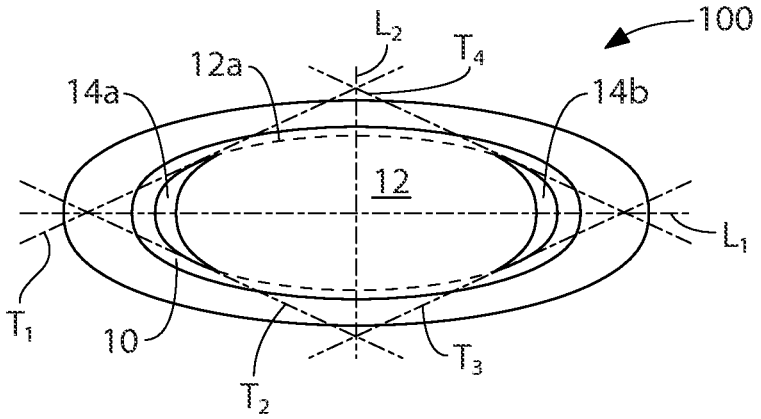
FIG. 3 is a top view of the bottle of FIG. 1.

FIGS. 1 to 3 illustrate a portion of a bottle 100 according to a first embodiment of the present invention. The bottle 100 has a body 20 having an internal chamber (not shown) and an opening (not shown), the opening being at a first end 1, or closure end, of the bottle 100. The bottle 100 further has a closure or cap 10 that is movable relative to the body 20 between a closed position (as illustrated) at which the closure 10 prevents the internal chamber from being in fluid communication with an exterior of the bottle 100, and an open position (not shown) at which the internal chamber is in fluid communication with the exterior of the bottle 100 via the opening. Looked at a different way, the bottle 100 comprises a first part 21 and a second part 22 connected to the first part 21 by snap-fit, wherein the body 20 forms the first part 21 and a first portion 22*a* of the second part 22, and the closure 10 forms a second portion 22*b* of the second part 22. In variations to this embodiment, the first and second parts 21, 22 may be connected in other ways, such as by adhesive, welding or screw-fitting to each other. In still further embodiments, the first and second parts 21, 22 may together be a unitary component. In yet further embodiments, the first part 21, the first portion 22*a*, and the second portion 22*b* may be separate components that are connected together in later manufacturing steps.

The closure 10 is connected to the body 20 by a living hinge (not shown), i.e. a thinned or otherwise weakened portion of the second part 22 about which the first portion 22*a* is rotatable relative to the second portion 22*b*, such that the closure 10 is movable relative to the body 20 between the closed and open positions while remaining connected to the body 20. The second portion 22*b* has a depression 23 formed in an exterior surface thereof adjacent the closure 10. A user may put their thumb or finger in the depression 23 and in contact with an edge of the closure 10, and then lift the closure 10 from its illustrated closed position to its open position. In other embodiments, the depression 23 may be omitted. In some embodiments, the closure 10 is instead movable relative to the body 20 between the closed and open positions by way of a pin and slot arrangement, a ball and socket arrangement, or other appropriate connection that allows the closure 10 to be movable relative to the body 20 in a non-destructive manner.

The bottle 100 has a main axis A that extends between the first end 1 of the bottle 100 and an opposite second end (not shown) of the bottle 100. The bottle 100, and more specifically the closure 10, comprises a first and second elements 14*a*, 14*b* lying in a plane P, which plane P is substantially perpendicular to the main axis A when the closure 10 is in the closed position. The first and second elements 14*a*, 14*b* are the portions of the first end 1 of the bottle 100 that are furthest along the main axis A from the second end of the bottle 100 when the closure 10 is in the closed position. The first and second elements 14*a*, 14*b* are the only portions of the bottle 100 that lie in the plane P.

The closure 10 further comprises a recessed portion 12 extending from the first element 14*a* to the second element 14*b*, which recessed portion 12 is recessed from the plane P in a direction along the main axis A towards the second end of the bottle 100. As a result of the provision of the recessed portion 12, the first and second elements 14*a*, 14*b* are separated from each other in the plane P by a gap G.

As used herein, the "viewing direction" is a direction into the page on which FIG. 2 is printed. As will be appreciated from consideration of FIG. 2, the recessed portion 12 includes (a) the contoured surface portions that face the plane P and define the profile of the bottle 100, and specifically the closure 10, between the first and second elements 14*a*, 14*b* when the bottle 100 is viewed in the viewing direction perpendicular to the main axis A and perpendicular to the direction in which the recessed portion 12 extends from the first element 14*a* to the second element 14*b*, and also (b) the contoured surface portions facing the plane P between the first and second elements 14*a*, 14*b* that are obscured from view in FIG. 2 by the first and second elements 14*a*, 14*b* themselves when the bottle 100 is viewed in the viewing direction, but which are visible in FIG. 1.

In this embodiment, the recessed portion 12 includes surface portions that face the plane P and are, at most, at no more than about 15° to the plane P. Accordingly, surfaces of the bottle 100 that are near-vertical (i.e. nearly aligned with the main axis A) are not considered to be comprised in the recessed portion 12.

In the embodiment, although not shown, the second, base end of the bottle 100 is substantially flat or planar in a plane parallel to the plane P, to permit the second end of the bottle 100 to stand stably on a resting surface. However, in alternative embodiments, the second, base end of the bottle 100 may take any form, if it is not intended that the bottle 100 be able to stand on the second end during storage of the bottle 100. In such alternative embodiments, the second end may be curved, wavy, angular, corrugated, pointed, bumpy, or of any other form.

In this non-limiting embodiment, each of the first and second elements 14*a*, 14*b* are non-annular planar surfaces lying in the plane P and separated from each other in the plane P by the gap G. That is, within the plane P, the first and second elements 14*a*, 14*b* are distanced from each other and are unconnected. Moreover, since the first and second elements 14*a*, 14*b* are non-annular, neither of the elements 14*a*, 14*b* encloses an area in the plane P. It is upon these elements 14*a*, 14*b* that the bottle 100 stands on a resting surface when inverted in such a manner that, when the elements 14*a*, 14*b* are in contact with the resting surface, a space S (see FIG. 2) is defined between the recessed portion 12 and the resting surface between the first and second elements 14*a*, 14*b*. As a result, water, such as water from a shower head, can flow through the space S to wash away some, much or all of any product remaining on the exterior of the first end 1 of the bottle 100, when the bottle 100 is standing on the resting surface.

In this embodiment, the elements 14*a*, 14*b* are respective first and second planar surfaces that lie in the plane P and that are integral with the rest of the closure 10, i.e. unitary therewith. The first element 14*a* is the same size and shape as the second element 14*b*. That is, the size of an area in the plane P occupied by the first surface 14*a* is the same as the size of an area in the plane P occupied by the second surface 14*b*. In a variation to this embodiment, the sizes of the areas in the plane P occupied by the first and second surfaces 14*a*, 14*b* may be different and/or the shapes of the areas in the plane P occupied by the first and second surfaces 14*a*, 14*b* may be different. In a further variation, the elements 14*a*, 14*b* may not be unitary with the rest of the closure 10, but may instead be adhered to the rest of the closure 10. In such a variation, the material of the elements 14*a*, 14*b* may be different to the material of the rest of the closure 10; the elements 14*a*, 14*b* may be of rubber or other high-friction material, while the rest of the closure 10 is of a hard or rigid polymer.

The first and second surfaces 14*a*, 14*b* together occupy a first area in the plane P. The recessed portion 12 projects, in a direction parallel to the main axis A, a second area onto the plane P, as illustrated in FIG. 3. The first area is approximately 4% of the sum of the first and second areas. However, in alternative embodiments, the first area may be anywhere between 1% and 25% of the sum of the first and second areas. Preferably, the first area is from any one of 1%, 3%, 4% and 5% of the sum of the first and second areas to any one of 10%, 15% and 20% of the sum of the first and second areas. Most preferably, the first area is between 1% and 5% of the sum of the first and second areas.

Accordingly, since the first area is only a fraction of the sum of the first and second areas, unlike an equivalent bottle in which the recessed portion 12 is omitted and the closure has a flat surface defined by the shape and extent of the combination of the first and second areas, when the first and second elements or surfaces 14*a*, 14*b* are standing on a resting surface, water, such as water from a shower head, is permitted to flow through a space S defined between the recessed portion 12 of the bottle 100 and the resting surface, so as to wash away some, much or all of any product remaining on the exterior of the first end 1 of the bottle 100. Moreover, the bottle designer has much more freedom when it comes to designing the shape of the rest of the first end 1 of the bottle 100 other than the first and second elements 14*a*, 14*b*, since only the form of the first and second elements 14*a*, 14*b*, which are separated by the gap G and thus do not extend across the full width and depth of the bottle 100 perpendicular to its height in a direction parallel to the main axis A, is dependent on the requirement for the bottle 100 to be able to stand stably on its first end 1.

As will be appreciated from FIG. 3, the first and second areas together define an ellipse. The first and second elements 14*a*, 14*b* are of the same shape in the plane P; the first and second surfaces 14*a*, 14*b* take the shape of respective crescents lying within the ellipse at opposite ends of the major axis of the ellipse. Two tangents T1, T2 to respective edges of the second area are tangential to a pair of respective edges of the first element 14*a*. Similarly, two other tangents T3, T4 to respective edges of the second area are tangential to a pair of respective edges of the second element 14*b*. Accordingly, edges of the recessed portion 12 transition smoothly into the edges of the first and second planar surfaces 14*a*, 14*b* when viewed in a direction along the main axis A, as per FIG. 3.

The bottle 100 has a width in a first direction (left to right in FIG. 2) perpendicular to the main axis A and a depth in a second direction (into the page of FIG. 2) perpendicular to both the main axis A and the first direction. The width is greater than the depth. As will be appreciated from FIG. 2, the first and second elements 14*a*, 14*b* are spaced apart in the width direction by a distance that is more than 50% of the width of the bottle 100, such as to give the bottle 100 stability when standing on its first end 1. Moreover, each of the first and second elements 14*a*, 14*b* extends in the width direction by a distance that is between about 4% and 6% of the width of the bottle 100, such as to maximize the size of the gap G and the width of the space S. Still further, each of the first and second elements 14*a*, 14*b* extends in the depth direction of the bottle 100 by a distance that is between 38% and 45% of the depth of the bottle 100. Yet further, the recessed portion 12 extends in the second, depth direction to a greater extent than each of the first and second elements 14*a*, 14*b*.

Each of the first and second elements 14*a*, 14*b* is symmetrical about a first lateral axis L1 that lies in the plane P (see FIGS. 1 and 3) and extends in the width direction of the bottle 100, i.e. in the direction in which the recessed portion 12 extends from the first element 14*a* to the second element 14*b*. In this embodiment, the first lateral axis L1 lies midway across the depth of the bottle 100 and thus midway between front and rear sides 3, 4 of the bottle 100, which front and rear sides 3, 4 extend between the first 1 and second ends of the bottle. Accordingly, the bottle 100 has good stability when standing in an inverted manner on the first and second elements 14*a*, 14*b*, since equal-sized portions of each of the respective elements 14*a*, 14*b* are provided on respective sides of the first lateral axis L1. In a variation to this embodiment, each of the first and second elements 14*a*, 14*b* is symmetrical about a second lateral axis L2 that lies in the plane, extends in the depth direction of the bottle 100, and is substantially perpendicular to the first lateral axis, which may lie midway between the outermost ends of the first and second elements 14*a*, 14*b* in the width direction (see FIGS. 1 and 3). In another variation to this embodiment, the first lateral axis L1 may not lie midway between the front and rear sides 3, 4, and/or the second lateral axis L2 may not lie midway between the outermost ends of the first and second elements 14*a*, 14*b*. In a further variation, one or both of the first and second elements 14*a*, 14*b* may not be symmetrical about either lateral axes L1 or L2. In some embodiments, the first and second elements 14*a*, 14*b* may be symmetrical about both first and second lateral axes L1 and L2. In this embodiment, the second element 14*b* is a mirror image of the first element 14*a* about the second lateral axis L2.

In further respective variations to the illustrated first embodiment, the first and second elements 14*a*, 14*b* may be of different shapes in the plane P. Moreover, one or both of the elements 14*a*, 14*b* may take the shape of a segment of a circle, a sector of an ellipse or of a circle, a crescent, an ellipse or a circle, a triangle, a quadrilateral such as a rectangle, square or diamond, another polygon, or a shape that follows the path of one of an arc, an S, a V, a U and a W. Still further, one or both of the elements 14*a*, 14*b* may have such a small width in the plane that it/they are considered one-dimensional in the plane, such as a straight line, a curved line or a line that follows the path of one of an arc, an S, a V, a U and a W.

Examples of differently-shaped elements are shown in FIGS. 4*a* to 6*b*, which are respective pairs of (a) top views and (b) side profiles of portions of bottles 100 of second, third and fourth embodiments of the present invention, respectively. Note that the same reference numerals are used to indicate elements corresponding to those discussed above for the first embodiment.

Figure 4A:
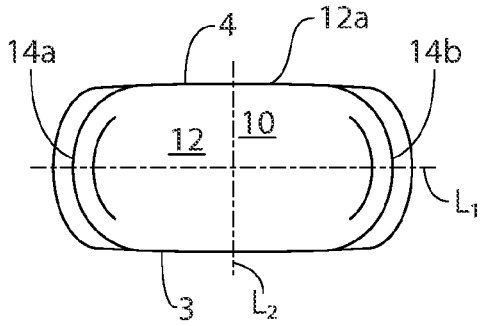
FIG. 4*a* is a top view of a portion of a bottle according to a second embodiment of the present invention.
Figure 4B:
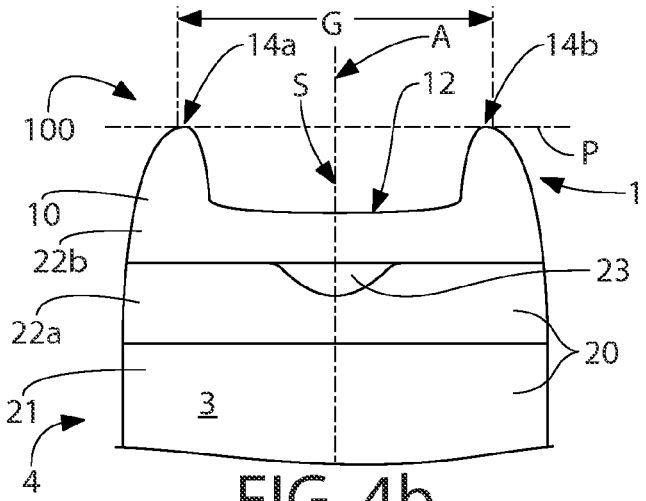
FIG. 4*b* is a front view of the portion of the bottle of FIG. 4*a;*

In second embodiment of FIGS. 4*a* and 4*b*, the first and second elements 14*a*, 14*b* lie in the plane P but are not planar surfaces, as such. Rather, the first and second elements 14*a*, 14*b* are non-annular, arc-shaped lines that are of such narrow width in the plane P that they are considered one-dimensional in the plane P. That is, the elements 14*a*, 14*b* each have a shape that follows the path of an arc. The first and second elements 14*a*, 14*b* are portions of respective non-planar, curved surfaces of the closure 10. The arc-shaped elements 14*a*, 14*b* are of the same size in the plane P, and both are symmetrical about a first lateral axis L1 that lies in the plane P (see FIG. 4*a*) and that lies midway between front and rear sides 3, 4 of the bottle 100. In this embodiment, the second arc-shaped element 14*b* is a mirror image of the first arc-shaped element 14*a* about a second lateral axis L2 that is substantially perpendicular to the first lateral axis L1, and that lies midway between the arc-shaped elements 14*a*, 14*b* along the plane P.

Each of the elements 14*a*, 14*b* occupies substantially zero area in the plane P, such that the first area is substantially zero. The closure 10 further comprises a recessed portion 12 extending between the elements 14*a*, 14*b* and projecting, in a direction parallel to the main axis A, a second area 12*a* of an elliptical or lozenge-shape onto the plane P. The first and second areas together define an elliptical or lozenge-shaped area in the plane P. Since the first area is substantially zero, the first area is substantially 0% of the sum of the first and second areas.

In some embodiments, the arc-shaped elements 14*a*, 14*b* may not be symmetrical about either one or both of the first and the second lateral axes L1, L2. In variations to this embodiment, only one of the elements 14*a*, 14*b* may be arc-shaped. In other variations, the non-annular, arc-shaped elements 14*a*, 14*b* may be of different sizes in the plane P. In still further variations, one of the elements 14*a*, 14*b* may have a shape other than a shape that follows the path of an arc.

In a variation to the illustrated second embodiment, one or both of the first and second elements 14*a*, 14*b* may comprise a surface in the plane P, in which case the one or both of the first and second elements 14*a*, 14*b* would be two-dimensional in the first plane and thus would occupy an area in the plane P. The surface(s) may be of any of the possible shapes discussed herein, such as a crescent, a rectangle, a circle, and a shape that follows the path of one of an arc, an S, a V, a U and a W. In any event, it is preferable that the first area is no more than 25% of the sum of the first and second areas.

Figure 5A:
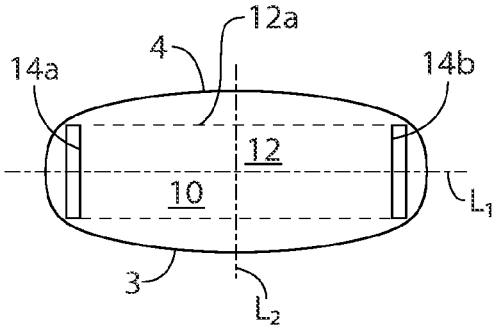
FIG. 5*a* is a top view of a portion of a bottle according to a third embodiment of the present invention.
Figure 5B:
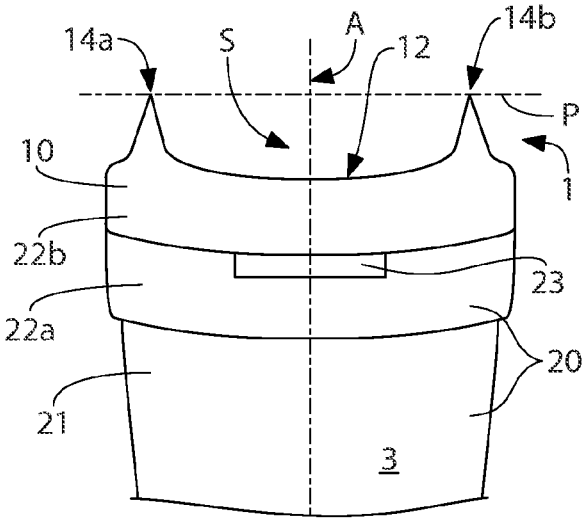
FIG. 5*b* is a front view of the portion of the bottle of FIG. 5*a;*

In third embodiment of FIGS. 5*a* and 5*b*, the first and second elements 14*a*, 14*b* lie in the plane P but again are not planar surfaces. Rather, the first and second elements 14*a*,

14*b* are straight, non-annular elements that are of such narrow width in the plane P that they are considered one-dimensional in the plane P. The first and second elements 14*a*, 14*b* are lines that are ridges of respective non-planar surfaces. The elements 14*a*, 14*b* are of the same size (substantially zero area) and shape in the plane P, and both are symmetrical about a first lateral axis L1 that lies in the plane P (see FIG. 4*a*) and that lies midway between front and rear sides 3, 4 of the bottle 100. In this embodiment, the first and second elements 14*a*, 14*b* are also symmetrical about a second lateral axis L2 that is substantially perpendicular to the first lateral axis L1, and that lies midway between the first and second elements 14*a*, 14*b* along the plane P. In some embodiments, the first and second elements 14*a*, 14*b* may not be symmetrical about either one or both of the first and the second lateral axes L1, L2.

Each of the elements 14*a*, 14*b* occupies substantially zero area in the plane P, such that the first area is substantially zero. The closure 10 further comprises a recessed portion 12 extending between the elements 14*a*, 14*b* and projecting, in a direction parallel to the main axis A, a second rectangular-shaped area 12*a* onto the plane P. The first and second areas together define a rectangular area in the plane P. Since the first area is substantially zero, the first area is substantially 0% of the sum of the first and second areas.

Figure 6A:
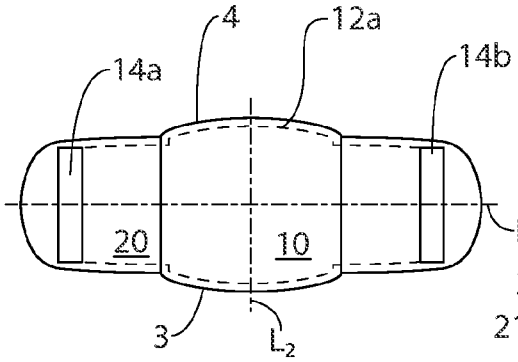
FIG. 6*a* is a top view of a portion of a bottle according to a fourth embodiment of the present invention.
Figure 6B:
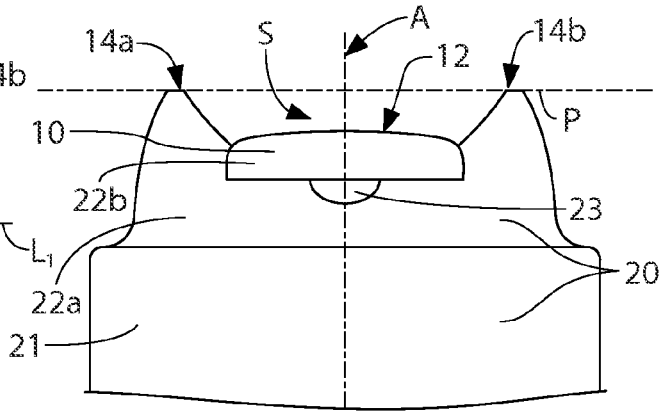
FIG. 6*b* is a front view of the portion of the bottle of FIG. 6*a.*

In fourth embodiment of FIGS. 6*a* and 6*b*, the first and second elements 14*a*, 14*b* are respective rectangular, planar, non-annular surfaces lying in a plane P. The first and second surfaces 14*a*, 14*b* are of the same size and shape in the plane P, and both are symmetrical about a first lateral axis L1 that lies in the plane P (see FIG. 6*a*) and that lies midway between front and rear sides 3, 4 of the bottle 100. In this embodiment, the first and second surfaces 14*a*, 14*b* are also symmetrical about a second lateral axis L2 that is substantially perpendicular to the first lateral axis L1, and that lies midway between the first and second surfaces 14*a*, 14*b* along the plane P. In some embodiments, the first and second surfaces 14*a*, 14*b* may not be symmetrical about either one or both of the first and the second lateral axes L1, L2.

Important to note in the fourth embodiment is the feature that the first and second elements 14*a*, 14*b* are comprised in the body 20 of the bottle 100, rather than the closure 10 of the bottle 100 as is the case in each of the first to third embodiments. In the first to third embodiments, the closure 10 is a unitary component with the first and second elements 14*a*, 14*b* being integrally formed with the second portion 22*b* of the second part 22 of the bottle 100. In contrast, in the fourth embodiment, the first and second elements 14*a*, 14*b* are part of the body 20. More specifically, the first and second elements 14*a*, 14*b* are integral with the rest of the body 20. That is, the body 20 is a unitary component, with the first and second elements 14*a*, 14*b* being integrally formed with a first portion 22*a* of a second part 22 of the bottle 100. Accordingly, in the fourth embodiment, the closure 10 is movable relative to the first and second elements 14*a*, 14*b* whereas, in the first to third embodiments, the first and second elements 14*a*, 14*b* and the closure 10 together are movable relative to the body 20. In a variation to the fourth embodiment, the first and second elements 14*a*, 14*b* may be joined to the rest of the body 20, e.g. by way of adhesive.

In the fourth embodiment, each of the elements 14*a*, 14*b* occupies an area in the plane P, such that the first area is more than zero. The bottle 100 further comprises a recessed portion 12 extending between the elements 14*a*, 14*b* and projecting, in a direction parallel to the main axis A, a second irregularly-shaped area 12*a* onto the plane P. The recessed portion 12 includes surface portions that face the plane P and are, at most, at no more than 45° to the plane. The first and second areas together define an irregularly-shaped area in the plane P. The first area is approximately 10% of the sum of the first and second areas, but in other embodiments the first area may be anywhere between 1% and 25% of the sum of the first and second areas.

As will be appreciated, in each of the second to fourth embodiments, when the first and second surfaces 14*a*, 14*b* are in contact with a resting surface, between the first and second surfaces 14*a*, 14*b* there is a space S between the recessed portion 12 and the resting surface, as in the first embodiment. Moreover, in each of the second to fourth embodiments, the bottle 100 comprises a first part 21 and the second part 22 connected to the first part 21, wherein the body 20 forms the first part 21 and a first portion 22*a* of the second part 22, and the closure 10 forms a second portion 22*b* of the second part 22. Again, in each embodiment, the closure 10 is connected to the body 20 by a living hinge (not shown) about which the first portion 22*a* is rotatable relative to the second portion 22*b*, such that the closure 10 is movable relative to the body 20 between the closed and open positions while remaining connected to the body 20. In some embodiments, the closure 10 is movable relative to the body 20 between the closed and open positions by way of a pin and slot arrangement, a ball and socket arrangement, or other appropriate connection that allows the closure 10 to be movable relative to the body 20.

In a variation to the fourth embodiment, one or both of the first and second surfaces 14*a*, 14*b* may be replaced by an element 14*a*, 14*b* that takes the shape of a segment of an ellipse or of a circle, a sector of an ellipse or of a circle, a crescent, an ellipse or a circle, a triangle, a diamond, another polygon or a shape that follows the path of one of an arc, an S, a V, a U and a W. The replacement element(s) 14*a*, 14*b* may be considered one-dimensional in the plane P and, as such, may be considered to occupy a very small area, or substantially no area, in the plane P. If both elements 14*a* and 14*b* are one-dimensional in the plane P, then the first area in the plane P is considered to be substantially zero. Therefore, in this variation to the illustrated fourth embodiment, the first area is substantially 0% of the sum of the first and second areas.

In preferable variations to the illustrated first to fourth embodiments, the first area in the plane P is at most 25% of the sum of the first and second areas in the plane P. More preferably, the first area in the plane P is at most 15% of the sum of the first and second areas in the plane P. More preferably, the first area in the plane P is at most 10% of the sum of the first and second areas in the plane P. Most preferably, the first area is at most 5% of the sum of the first and second areas.

As will readily be appreciated, by providing the bottle of the first to fourth embodiments of the present invention with the gap G separating the first and second elements or surfaces 14*a*, 14*b*, when the first and second elements or surfaces 14*a*, 14*b* are standing on a resting surface, water, such as water from a shower head, is permitted to flow through a space S defined between the recessed portion 12 of the bottle 100 and the resting surface, so as to wash away some, much or all of any product remaining on the exterior of the first end 1 of the bottle 100. Moreover, the bottle designer has much more freedom when it comes to designing the shape of the rest of the first end 1 of the bottle 100 other than the first and second elements or surfaces 14*a*, 14*b*, since only the form of the first and second elements or surfaces 14*a*, 14*b*, which are separated by the gap G and thus do not extend across the full width and depth of the bottle 100 perpendicular to its height, is dependent on the requirement for the bottle 100 to be able to stand stably on its first end 1.

It is to be noted that features of the first to fourth embodiments are combinable together to form further embodiments of the present invention other than those illustrated in the Figures. For example, the feature of the fourth embodiment that the first and second elements or surfaces 14*a*, 14*b* are comprised in the body 20 rather than in the closure 10 could be employed in any one of the first to third embodiments to provide a further embodiment. Other possible embodiments will be apparent to the skilled person.

The invention claimed is:

1. A bottle comprising:

a body having an internal chamber and an opening, the opening being at a first end of the bottle; and a closure movable relative to the body between a closed position at which the closure prevents the chamber from being in fluid communication with an exterior of the bottle, and an open position at which the chamber is in fluid communication with the exterior of the bottle via the opening;

wherein the first end of the bottle comprises first and second elements and a recessed portion extending from the first element to the second element;

wherein each of the first and second elements is a line or a planar surface in a plane substantially perpendicular to a main axis extending between the first end of the bottle and an opposite second end of the bottle, the first and second elements being respective portions of the first end of the bottle that are furthest along the main axis from the second end of the bottle;

wherein the recessed portion is recessed from the plane in a direction along the main axis towards the second end of the bottle, whereby the first and second elements are separated from each other in the plane by a gap, the first and second elements together occupying a first area in the plane;

wherein the recessed portion projects, in a direction parallel to the main axis, a second area onto the plane; and wherein the first area is between 1% and 25% of the sum of the first and second areas.

2. The bottle of claim 1, wherein the first area is from any one of 1%, 3%, 4% and 5% of the sum of the first and second areas to any one of 10%, 15% and 20% of the sum of the first and second areas.

3. The bottle of claim 2, wherein the first area is between 1% and 5% of the sum of the first and second areas.

4. The bottle of claim 1, wherein one or each of the first and second elements is a planar surface.

5. The bottle of claim 1, wherein the first and second areas together define an ellipse or a circle.

6. The bottle of claim 5, wherein one or each of the first and second elements occupies an area in the plane that is a sector or a segment of the ellipse or of the circle or that is a crescent lying within the ellipse or within the circle.

7. The bottle of claim 5, wherein the first element is diametrically opposite the second element in the ellipse or the circle.

8. The bottle of claim 1, wherein a tangent to an edge of the second area is tangential to a part of one of the first and second elements at the point where the edge meets the part.

9. The bottle of claim 1, wherein the bottle has a width in a first direction perpendicular to the main axis and a depth in a second direction perpendicular to both the main axis and the first direction.

10. The bottle of claim 9, wherein the width is greater than the depth.

11. The bottle of claim 9, wherein the first and second elements are spaced apart in the first direction by a distance that is more than 40% of the width.

12. The bottle of claim 9, wherein one or each of the first and second elements extends in the first direction by a distance that is between 2% and 10% of the width.

13. The bottle of claim 9, wherein one or each of the first and second elements extends in the second direction by a distance that is between15% and 70% of the depth.

14. The bottle of claim 1, wherein one or each of the first and second elements is symmetrical about a first axis that lies in the plane and/or symmetrical about a second axis that lies in the plane and is substantially perpendicular to the first axis.

15. The bottle of claim 14, wherein the first axis extends in the first direction and the second axis extends in the second direction.

16. The bottle of claim 9, wherein one or each of the first and second elements is provided midway across the depth of the bottle.

17. The bottle of claim 9, wherein the recessed portion extends in the first direction from the first element to the second element.

18. The bottle of claim 17, wherein the recessed portion extends in the first and/or second direction to a greater extent than one or each of the first and second elements.

19. The bottle of claim 1, wherein the first and second elements are comprised in the closure.

20. The bottle of claim 1, wherein the first and second elements are integral with the rest of the closure.

21. The bottle of claim 1, wherein the first and second elements are comprised in the body.

22. The bottle of claim 21, wherein the first and second elements are integral with the rest of the body.

23. The bottle of claim 1, wherein the size of an area in the plane occupied by the first element is substantially equal to the size of an area in the plane occupied by the second element.

24. The bottle of claim 1, wherein the first element is substantially the same shape as the second element.

25. The bottle of claim 1, wherein one or each of the first and second elements is substantially arc- or crescent-shaped.

26. The bottle of claim 1, wherein one or each of the first and second elements is non-annular.

27. The bottle of claim 1, wherein, when the first and second elements are in contact with a resting surface, between the first and second elements there is a space between the recessed portion and the resting surface.

28. The bottle of claim 1, wherein the closure remains connected to the body during movement of the closure relative to the body between the closed position and the open position.

29. The bottle of claim 1, wherein the closure is connected to the body via a hinge.

30. The bottle of claim 1, wherein the bottle comprises a first part and a second part connected to the first part, wherein the body forms the first part and a first portion of the second part, and wherein the closure forms a second portion of the second part.

31. The bottle of claim 1, wherein an area in the plane occupied by one or each of the first and second elements is substantially zero.

32. The bottle of claim 1, wherein the first and second elements are the only portions of the bottle that lie in the plane.

* * * * *